United States Patent [19]

Daniel

[11] 4,452,166

[45] Jun. 5, 1984

[54] FOIL STABILIZED MONOHULL VESSEL

[76] Inventor: Nathan I. Daniel, 948 Kailiu Pl., Honolulu, Hi. 96825

[21] Appl. No.: 323,378

[22] Filed: Nov. 20, 1981

[51] Int. Cl.[3] ..... B63B 1/30

[52] U.S. Cl. ..... 114/282; 114/61; 114/123

[58] Field of Search ..... 114/56, 57, 59, 61, 114/271, 274, 275, 276, 277, 278, 279, 280, 281, 282, 283

[56] References Cited

U.S. PATENT DOCUMENTS

| | | | |
|---|---|---|---|
| 3,081,728 | 3/1963 | Wilterdink | 114/282 |
| 3,179,078 | 4/1965 | Popkin | 114/126 |
| 3,425,383 | 2/1969 | Scherer | 114/282 |
| 3,430,595 | 3/1969 | Tulleners | 114/61 |
| 3,541,987 | 11/1970 | Barkley | 114/61 |
| 3,949,695 | 4/1976 | Pless | 114/274 |

*Primary Examiner*—Trygve M. Blix
*Assistant Examiner*—Jesûs D. Sotelo

[57] ABSTRACT

A foil stabilized monohull vessel which functions as a multiple hull vessel at rest or at low speeds is described. The vessel comprises a main center hull which supports a deck thereover, and a stabilizing structure disposed on either side of the deck. The stabilizing structure includes floats which are intended to rest on the water when the vessel is at rest or at low speeds, and intended to be removed from the water when the vessel is at high speeds. The stabilizing structure also includes one or more pairs of opposed foils which act as stabilizers disposed on the port and starboard sides of the vessel. The stabilizer foils act in concert to reduce roll and improve maneuverability.

8 Claims, 8 Drawing Figures

FOIL STABILIZED MONOHULL VESSEL

This patent application is related to my co-pending U.S. patent application Ser. No. 913,574, filed June 5, 1978 and entitled WATERCRAFT.

This invention relates to an improved watercraft configured as a multihull vessel at slow speed or at rest which changes its configuration at cruising speed to a foil stabilized monohull. The vessel of this invention is intended to increase fuel efficiency at cruising speed by reducing drag while providing foil stabilizers. The stabilizers reduce roll to nearly zero, permit a smaller overall beam and provide for increased maneuverability including banked turns.

Multihulled vessels such as catamarans or trimarans which use one or more outboard hulls for stabilization have been known for many years. In addition, hydrofoil vessels have also been known for many years. In hydrofoil vessels the foils normally raise the hull above water at cruising speeds and provide support whereby at low speeds the vessel rests on the water, and at high speeds the vessel rises from the water to be supported by the upward thrust upon the foils. Such vessels have encountered difficulties in docking, or in shallow water, due to the need to raise the foils. The foils on which the boat rides at high speeds are carried on struts which project beneath the boat hull. Therefore, when the boat is hull borne, an appreciable depth of water is required unless a means for raising the foils is also provided. This is the principal problem addressed, for example, in U.S. Pat. Nos. 3,354,857, 3,425,383, 3,456,611, and 3,081,728.

The conventional hydrofoil structure, however, is in sharp contrast to the foil stabilized monohull of this invention. It has been discovered that the outboard stabilizers of this invention can provide a stable craft at slow speeds or at rest, but may be altered at high speeds to form a foil stabilized monohull vessel with greatly reduced drag for increased fuel efficiency, maneuverability, and roll stability at high speeds.

The device of this invention includes a central hull which supports a deck thereover. The deck and hull are preferably interconnected by struts forming a truss for support. The hull mounts preferably forward and stern rudders and forward, central and stern props driven by conventional engines. The hull may also be submersible or semi-submersible in that it may be provided with a pump means for flooding or evacuating compartments in the interior so that the hull may operate as a ballast tank also.

The deck disposed over the hull may include passenger compartments, storage compartments, and space for parking automobiles.

Stability for the vessel is provided by outrigger means. The outrigger means includes, preferably, a plurality of floats and a plurality of stabilizer foils. The floats are intended to stabilize the vessel at low speeds, and to be lifted from the water or otherwise removed to reduce drag at high speeds. The stabilizer foils function solely to stabilize and maneuver the vessel.

Accordingly, it is an object of this invention to provide a sea-going vessel configured as a multihull vessel at slow speeds or at rest and as a foil stabilized monohull at higher speeds or cruising speeds.

It is another object of this invention to provide a vessel having outrigger float means which ma be used to assist in stabilization at low speeds or at rest, but at high speeds may be altered to eliminate or reduce drag caused thereby.

It is yet another object of this invention to provide a watercraft having a monohull with a deck mounted thereover, the monohull being semi-submersible and stabilized by outrigger mounted foils.

It is yet another object of this invention to provide a vessel having a central monohull mounting a deck thereover and outriggers, which outriggers include movable floats which may be raised from the water at high speeds and stabilizer foils which stabilize the vessel against roll and assist in maneuverability.

These and other objects will become readily apparent with reference to the drawings and following description wherein.

Figure 1:
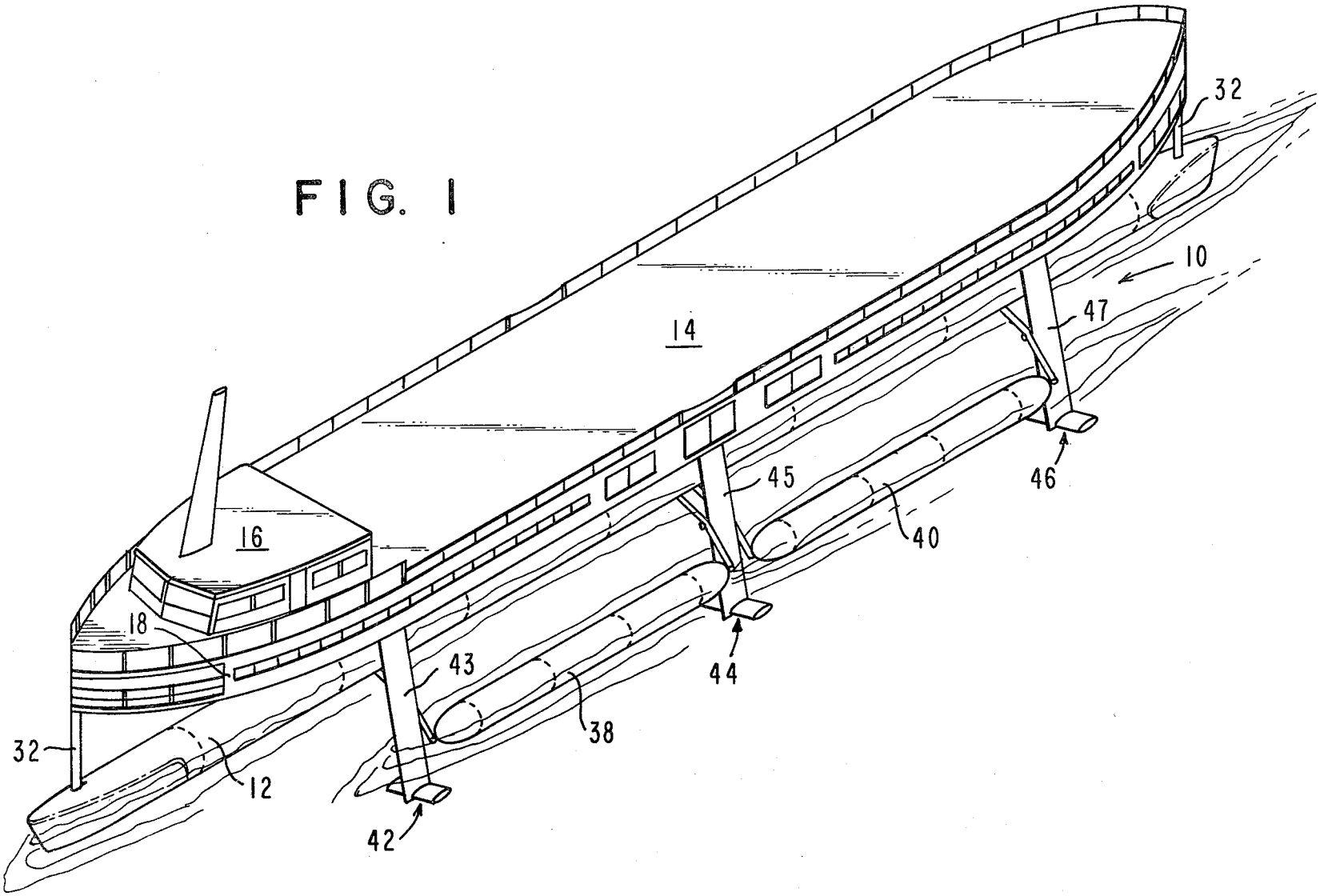
FIG. 1 is a perspective view of a preferred embodiment of this invention.
Figure 2:
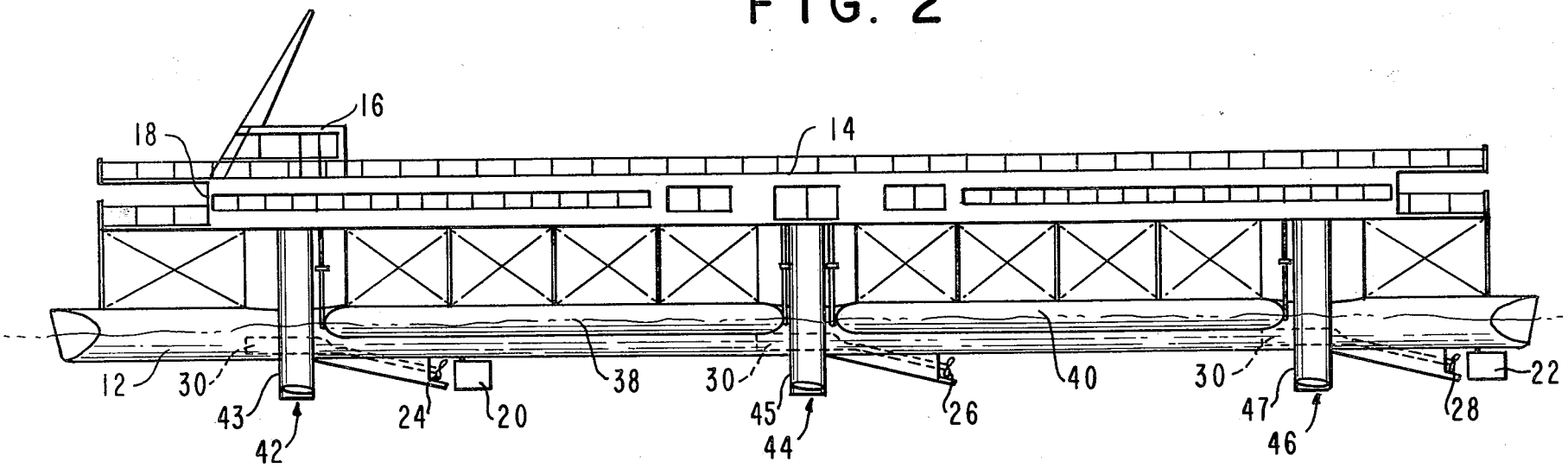
FIG. 2 is a side view of the vessel of FIG. 1.
Figure 3:
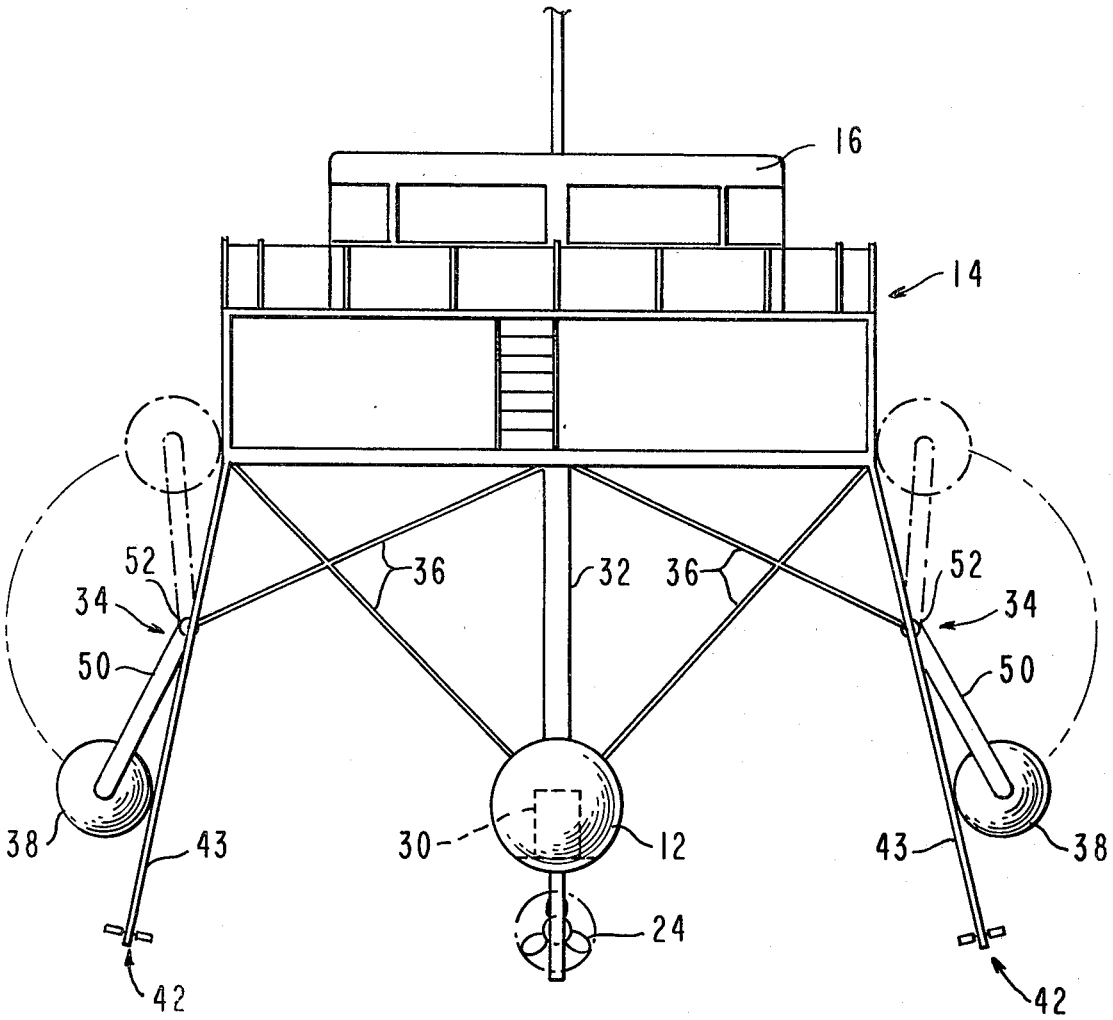
FIG. 3 is a front view of the vessel of FIG. 1 illustrating movement of the floats in phantom.

With attention to the drawings, and to FIGS. 1–3, in particular, the vessel of this invention 10 in general comprises a main hull 12 which may be hollow and may be filled or emptied with water as needed for ballast with a pump means (not shown) of conventional design. The main hull 12 supports a deck 14 which is intended to be of considerable size. Deck 14 may support a bridge 16 and/or storage compartments (not shown). In addition, deck 14 could support cars if the vessel is to be used as a ferry. The deck may also include a lower passenger area 18 as desired.

With attention to FIG. 2, hull 12 typically mounts forward and stern rudders 20 and 22, and the means for propelling the vessel. In this embodiment forward, mid-ship and stern props 24, 26 and 28 are provided which may be driven by conventional diesel engines 30, or other power means as obvious to those skilled in the art.

With particular attention to FIG. 3, main hull 12 supports deck 14 by interconnecting cord support members (not shown), and additional vertical supports 32. In addition, the vessel is stabilized by outrigger means 34 depending from the port and starboard sides of deck 14 and interconnected with main hull 12 by lateral supports 36.

The port and starboard outrigger means are identical, and in this embodiment include forward and rear torpedo-shaped floats 38 and 40 and, with reference to FIGS. 1, 2 and 3, forward, mid-ship, and rear stabilizer foils 42, 44, and 46. Each of said stabilizer foils depends from a substantially vertical mount 43, 45, and 46, respectively, attached to deck 14, and secured to main hull 12 as shown in FIG. 3. Forward float 38 is then movably mounted between supports 43 and 45, and rear float 40 is movably mounted between vertical supports 45 and 47. The floats are attached by support members 50 which include a joint 52 whereby the float members may be rotated out of engagement with the water from the position shown in FIG. 1 to the position shown in phantom in FIG. 3. The means for moving the floats (not shown) may be a conventional hydraulic piston or other means which will be obvious to those skilled in the art. In addition, float members 38 and 40 need not be fully rotated to the position shown in phantom in FIG. 3. They may be moved only upwardly, out of engagement with the surface of the water, to eliminate drag on vessel 10 at high speeds or cruising speed.

As described above, stabilizer foils 42, 44 and 46 are primarily intended to stabilize the vessel 10 and may be controlled so that port and starboard stabilizers are continually operating in opposite directions to thereby nearly eliminate roll of the vessel. In addition, as will be obvious to those skilled in the art, at cruising speeds, the stabilizers may be used to make a banked turn.

It must be emphasized that the foil stabilizers 42, 44, and 46 do not support the vessel as in the case of hydrofoils. The main hull 12 supports the vessel and the foils are merely utilized for stabilization. At low speeds compartments in the center hull may be flooded and floats 38 and 40 lowered. Then, at cruising speed, the main hull will be pumped out for buoyancy, floats 38 and 40 rotated out of the water to reduce drag, and port and starboard stabilizers 42, 44 and 46 utilized to stabilize the vessel. Maneuvering is further assisted in the conventional fashion by use of props 24, 26, and 28, in combination with forward and rear rudders 20 and 22. Meanwhile, roll is controlled by the stabilizers which, as described above, are oppositely angled on opposite sides of the vessel and are continually changed in angle to reflect the condition of the vessel.

It is contemplated that the angle of the foils will be controlled mechanically, or may be computerized, as will be obvious to those skilled in the art.

Figure 4:
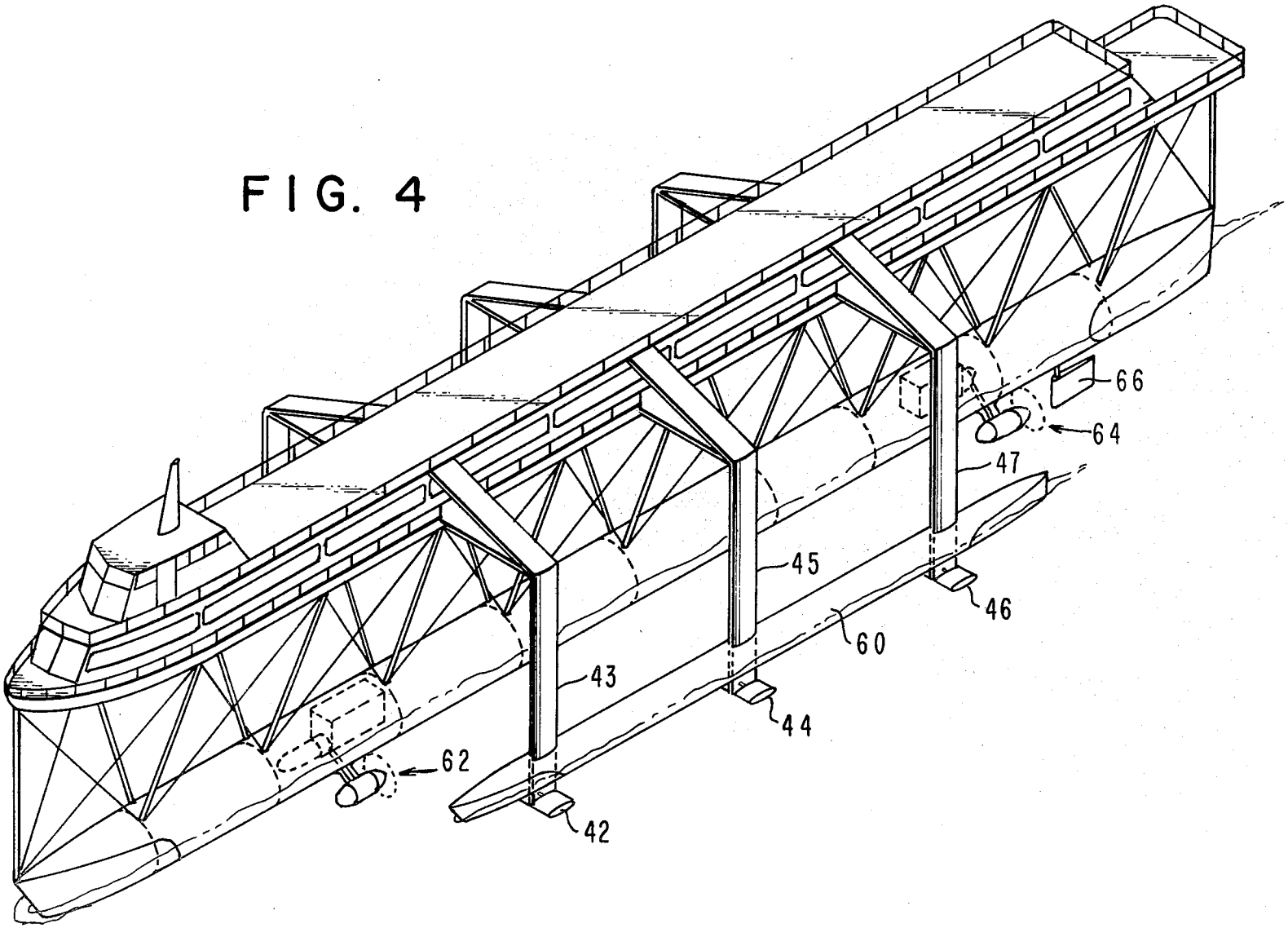
FIG. 4 is a perspective view of an alternate embodiment of this invention.
Figure 5:
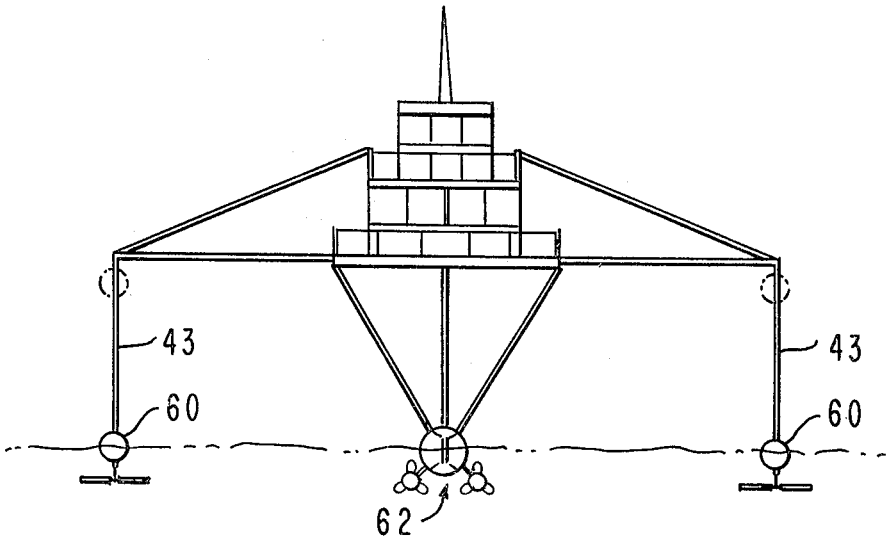
FIG. 5 is a front view of the embodiment of FIG. 4.

With attention to FIGS. 4 and 5, an alternative embodiment of this invention substitutes a single outrigger float 60 disposed on either side of the vessel. The identical stabilizer foils 42, 44, and 46, are provided as well as their supports 43, 45 and 47, on either side of the vessel. However, in this embodiment, float 60 is slidably received on vertical supports 43, 45 and 47, and is intended to move from the position shown in FIG. 5, to the position shown in phantom in FIG. 5 as the vessel changes from a slow speed or rest condition to high speed or cruising condition. The floats 60 similarly stabilize the vessel at low speeds or at rest as described above relative to floats 38 and 40, and drag is reduced at cruising speed by vertically raising the float 60 by any conventional means (not shown) such as a hoist, wench, or the like.

In this embodiment there is illustrated a twin prop 62 at the forward position and a twin prop 64 at the rear position to propel the vessel. The props are driven in a conventional fashion and, as will be obvious to those skilled in the art, rudders 66 are provided.

Figure 6:
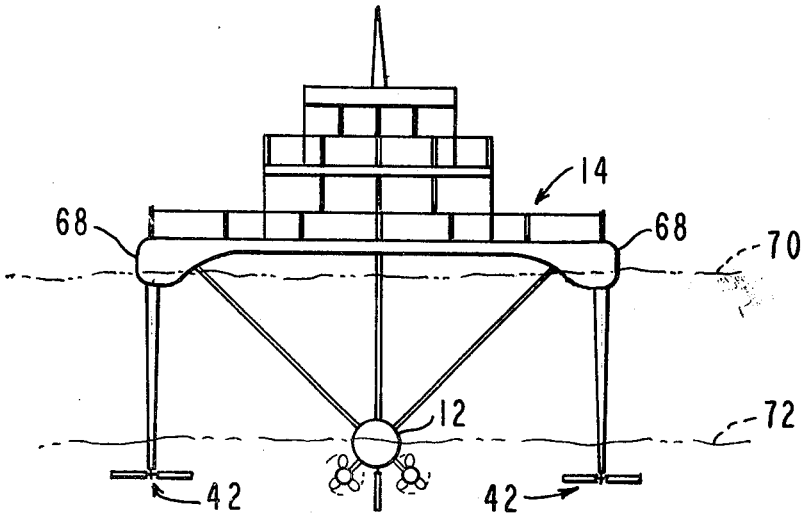
FIG. 6 is a front view of yet an alternative embodiment of this invention.

With attention to FIG. 6, there is described therein yet another alternative embodiment. In the embodiment of FIG. 6 float members 68 are permanently mounted on the deck 14 on the starboard and port sides. These float members do not move. Instead, the vessel is raised or lowered by flooding or evacuating the main hull 12. Accordingly, at rest, or at low speeds hull 12 will be flooded, and the water level will be as shown at reference No. 70. In order to reduce drag at high speeds, the hull is evacuated causing the vessel to rise to the position shown at the water level 72. In either position stabilizers 42, 44 and 46 as shown in other embodiments are utilized.

Figure 7:
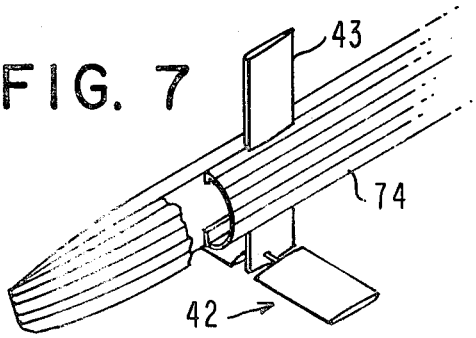
FIG. 7 is a fragmentary view of yet another embodiment of this invention showing an inflatable float in the inflated position.
Figure 8:
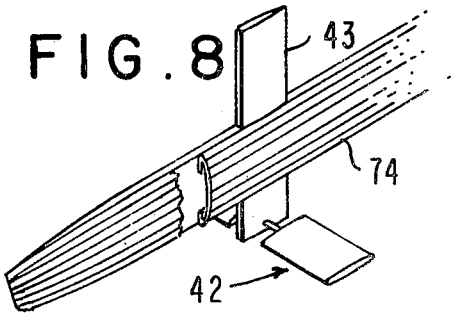
FIG. 8 is a fragmentary view similar to FIG. 7 showing the float in deflated condition.

Finally, yet another embodiment is shown in FIGS. 7 and 8. The embodiment of FIGS. 7 and 8 is similar to that of FIG. 4 except that the float members 74 are not slidable on vertical supports 43, 45, and 47. Instead, the float members are inflatable structures. Accordingly, at rest or slow speeds float members 74 are inflated and appear to be indentical or approximate the structure shown in FIG. 4. In order to reduce drag, however, at high speeds, the float members 74 are deflated as shown in FIG. 8. The difference then between the embodiment of FIGS. 4 and 5 and FIGS. 7 and 8 appears at high speeds or cruising speed. In the embodiment of FIGS. 4 and 5, the float is raised vertically out of the water to the position shown in phantom in FIG. 5. In the embodiment of FIGS. 7 and 8, the float 74 is deflated to form the streamlined structure shown at FIG. 8.

Accordingly, four embodiments of this invention have been presented. In each of the four embodiments the stabilizing foils are not utilized to raise the vessel as in the case of a hydrofoil, but rather to stabilize the vessel. Therefore, the foils being outboard of the main hull will act in opposite directions to stabilize the main hull, normally. At cruising speed the foils and their vertical supports present only minimal drag, and the overall outrigger means consists of only the foils and their vertical supports. At slow speeds or at rest the float members contact the water so that the outrigger means consists of the combination of the floats and the foils with their vertical supports.

Therefore, in the embodiments of FIGS. 1-3, 4 and 5, and 7 and 8, the main hull supports the vessel at al times and the overall draft does not increase substantially between the low speed or rest condition and the cruising speed condition. In the embodiment of FIG. 6 the vessel does translate between a high and a low condition. However, the foils do not raise and lower the vessel. In the high condition or cruising speed condition the main hull is substantially evacuated or pumped empty of water. When the main hull is filled with water the vessel enters the low condition wherein the floats mounted on the deck provide the increased stability necessary.

However, the embodiment of FIGS. 1-3 is preferred. In this embodiment the float members are separately mounted and raised or lowered as desired. Similarly, in the embodiment of FIGS. 4 and 5 the float members are raised and lowered, but are not separately mounted and the vertical supports for the foils also directly support the float members.

In contrast, in the embodiment of FIGS. 7 and 8, the float members are not raised and lowered, but rather inflated and deflated to provide stability when required at low speeds or at rest, and at cruising speed to reduced drag to a minimum as shown in FIG. 8.

As a result, the vessel of this invention achieves many of the desired qualities of catamarans or trimarans at low speeds or at rest, and at high speeds provides drastically reduced drag without losing roll stability. If, for example, the vessel, at high speed, begins listing to port, the port side foils will be rotated to an angle of attack which provides lift or upward thrust while the starboard side foils will take on an angle of attack which provides downward thrust. The change of angle of attack will then tend to right the vessel. As will be obvious to those skilled in the art, in large vessels of this invention an automatic control system for the foils would be desirable, although manual controls with power assist could be utilized.

As also will be obvious to those skilled in the art the preferred embodiment of this invention pictures three pairs of opposed stabilizing foils with two sets of floats mounted therebetween. Clearly, this invention is not intended to be limited to the number of foils or the configuration of the float means. The numbers of stabilizing foils required will be a function of the size of the vessel and other considerations well known to those skilled in the art. The number and shape of the floats which with the foils comprise the outrigger means also are a matter of design choice, within the competence of those skilled in the art. The invention then is intended to comprehend an outrigger means for a monohull vessel which will enable said vessel to function as a multiple hull vessel at rest or at low speeds and to function as a foil stabilized monohull at cruising speeds.

The invention may be embodied in other specific forms without departing from the spirit or essential characteristics thereof. The present embodiments are, therefore, to be considered in all respects as illustrative and not restrictive, the scope of the invention being indicated by the appended claims and all changes which come within the meaning and range of equivalency of the claims are, therefore, intended to be embraced therein.

What is claimed as new and desired to be secured by Letters Patent of the United States is:

1. A foil-stabilized monohull vessel comprising:

a central elongated hull and propulsion and rudder means mounted on said vessel; deck means mounted on said hull and disposed thereover, for housing passengers, crew, or cargo, said deck means having a port side and a starboard side disposed parallel to the longitudinal axis of said hull;

first and second outrigger means mounted, respectively, at the port and starboard sides of said deck means, said outrigger means including stabilizer foils adapted to stabilize said vessel against roll, said foils being mounted at the distal end of a vertical support depending from said deck means, and float means for stabilizing said vessel when said vessel is at rest or at low speeds; and means carried by said vessel for minimizing drag created by said float means when said vessel is at cruising speed by effectively eliminating support for said vessel by said float means, said means for minimizing drag permitting said vessel at cruising speed to be supported at the water surface by said hull and stabilized by said foils;

said float means and means for minimizing drag further comprising a plurality of float members carried by said vessel and means for selectively moving said float members between a water displacement condition wherein said members stabilize said deck means and a suspended position wherein said members do not displace water.

2. The vessel of claim 1 further comprising means for movably securing said float members to the vertical supports for said stabilizer foils.

3. The vessel of claim 2 wherein said float members are rotatably mounted on said supports.

4. The vessel of claim 2 wherein said float members are slidably mounted on said supports.

5. A foil-stabilized monohull vessel comprising:

a central elongated hull and propulsion and rudder means mounted on said vessel; deck means mounted on said hull and disposed thereover, for housing passengers, crew, or cargo, said deck means having a port side and a starboard side disposed parallel to the longitudinal axis of said hull;

first and second outrigger means mounted, respectively, at the port and starboard sides of said deck means, said outrigger means including stabilizer foils adapted to stabilize said vessel against roll, said foils being mounted at the distal end of a vertical support depending from said deck means, each of said port side foils being disposed opposite each of said starboard foils coaxially along the longitudinal axis of said hulls, and float means for stabilizing said vessel when said vessel is at rest or at low speeds, said float means comprising a plurality of inflatable float members mounted on said vertical supports; and means carried by said vessel for minimizing drag created by said float means when said vessel is at cruising speed by effectively eliminating support for said vessel by said float means, said means for minimizing drag permitting said vessel at cruising speed to be supported at the water surface by said hull and stabilized by said foils.

6. The vessel of claim 5 wherein said float means and means for minimizing drag further comprise means for selectively inflating and deflating said float members.

7. A foil-stabilized monohull vessel comprising:

a central elongated hull and propulsion and rudder means mounted on said vessel; deck means mounted on said hull and disposed thereover, for housing passengers, crew, or cargo, said deck means having a port side and a starboard side disposed parallel to the longitudinal axis of said hull;

first and second outrigger means mounted, respectively, at the port and starboard sides of said deck means, said outrigger means including stabilizer foils adapted to stabilize said vessel against roll, said foils being mounted at the distal end of a vertical support depending from said deck means, each of said port side foil being disposed opposite each of said starboard foils coaxially along the longitudinal axis of said hulls, and float means for stabilizing said vessel when said vessel is at rest or at low speeds; and means carried by said vessel for minimizing drag created by said float means when said vessel is at cruising speed by effectively eliminating support for said vessel by said float means, including pump means for filling said hull with water and for pumping said water from said hull, said means for minimizing drag permitting said vessel at cruising speed to be supported at the water surface by said hull and stabilized by said foils.

8. The vessel of claim 7 further comprising float members mounted on the port and starboard portions of said deck means so that when said hull contains water said float members will support said deck means.

* * * * *